US007119289B2

(12) United States Patent
Lacroix

(10) Patent No.: US 7,119,289 B2
(45) Date of Patent: Oct. 10, 2006

(54) PUSH BUTTON KEYPAD AND KNOB FOR MOTOR VEHICLE CONTROL PANEL

(75) Inventor: Louis Lacroix, Champigny sur Marne (FR)

(73) Assignee: Valeo Climatisation, La Verriere (FR)

( * ) Notice: Subject to any disclaimer, the term of this patent is extended or adjusted under 35 U.S.C. 154(b) by 0 days.

(21) Appl. No.: 10/938,175

(22) Filed: Sep. 10, 2004

(65) Prior Publication Data

US 2005/0061640 A1 Mar. 24, 2005

(30) Foreign Application Priority Data

Sep. 18, 2003 (FR) ..... 03 10985

(51) Int. Cl.
*H01H 9/26* (2006.01)

(52) U.S. Cl. ..... 200/5 R; 200/5 A

(58) Field of Classification Search ..... 200/5 R, 200/5 A, 5 D, 5 E, 314, 341–344
See application file for complete search history.

(56) References Cited

U.S. PATENT DOCUMENTS 3,902,818 A * 9/1975 Boone ..... 404/10
4,394,546 A * 7/1983 Harumatsu ..... 200/5 R
4,463,234 A * 7/1984 Bennewitz ..... 200/516
4,654,488 A * 3/1987 Westfall ..... 200/5 R
4,774,973 A * 10/1988 Gueret ..... 220/326
5,430,262 A * 7/1995 Matsui et al. ..... 200/5 A
6,125,785 A * 10/2000 Asheri ..... 116/148
6,313,420 B1 * 11/2001 Ohashi ..... 200/302.1
6,359,243 B1 * 3/2002 Nakade et al. ..... 200/6 A
6,441,753 B1 * 8/2002 Montgomery ..... 341/34
6,567,074 B1 * 5/2003 Numata et al. ..... 345/169
6,771,992 B1 * 8/2004 Tomura et al. ..... 455/575.1
6,800,819 B1 * 10/2004 Sato et al. ..... 200/5 R
2002/0027062 A1 * 3/2002 Shibutani et al. ..... 200/5 R
2002/0128112 A1 * 9/2002 Hanatani ..... 475/349
2003/0226745 A1 * 12/2003 Sato et al. ..... 200/5 R
2004/0060807 A1 * 4/2004 Nishimoto et al. ..... 200/553
2004/0206615 A1 * 10/2004 Aisenbrey ..... 200/262

* cited by examiner

*Primary Examiner*—Elvin Enad
*Assistant Examiner*—Lisa Klaus
(74) *Attorney, Agent, or Firm*—Ronald Courtney

(57) ABSTRACT

The invention relates to a keypad (10) for a control panel, in particular for a motor vehicle instrument system, comprising a front (30) provided with openings (32) through which a number of push-buttons (20) are placed, each positioned facing a contactor (14) fixed to a card (12), characterized in that the buttons (20) are linked together at least in groups of two to form a unitary set (22) and are placed with respect to one another on the keypad (10) such that each button (20) can be moved individually and pushing thereof causes solely actuation of the contactor (14) assigned to said button, without any effect on the contactors of the other buttons.

27 Claims, 4 Drawing Sheets

PUSH BUTTON KEYPAD AND KNOB FOR MOTOR VEHICLE CONTROL PANEL

FIELD OF THE INVENTION

The invention relates to a keypad provided with push-buttons and to a knob equipped with such a keypad, in particular for a motor vehicle control panel.

BACKGROUND OF THE INVENTION

There are currently many types of keypad for motor vehicle control panels, in particular for an instrument system.

In particular, there are keypads in which the buttons are not linked together and are each provided with guidance and foolproofing means for preventing them from jamming. Moulding of the guidance and foolproofing means into the front of the control panel is often delicate, and the same is true of the guide ribs of the buttons associated therewith. This involves successive adjustments in the moulds which are therefore complex and expensive to produce. Moreover, each button has to be mounted the correct way upon assembly, and this takes a lot of time.

There are also keypads comprising buttons that are not guided, but these have to withstand a high return force which is harmful to the button and adversely affects the ease of use.

SUMMARY OF THE INVENTION

In order to solve this problem, the invention proposes grouping the buttons together and positioning them in the keypad so as to facilitate use thereof without the need for foolproofing or guidance means.

More specifically, the object of the invention is a keypad for a control panel, in particular for a motor vehicle instrument system, comprising a front provided with openings through which a number of push-buttons are placed, each positioned facing a contactor fixed to a card, in which the buttons are linked together at least in groups of two to form a unitary set and are placed with respect to one another on the keypad such that each button can be moved individually and pushing thereof causes solely actuation of the contactor assigned to said button, without any effect on the contactors of the other buttons.

According to some preferred embodiments of the present invention:

- the buttons are secured to a common base arranged under the front so that pushing a given button to actuate its associated contactor causes the base to tilt, without jamming, about an axis that is essentially perpendicular to the pushing direction of said button and passes through at least one other button of the set of buttons;
- the buttons and their base are moulded in one piece by plastic injection moulding;
- the displacement travel of each button is between about 0.25 and 1.5 mm, preferably 0.5 mm;
- the base and the buttons are made of rigid or flexible material;
- the buttons are spaced apart from one another laterally by a few millimetres to a few centimetres, depending on the material used, and preferably by one millimetre to one centimetre;
- there may be two buttons or else three to form a triangle, for example an equilateral triangle, or else four to form a square. In the case of a triangle, the axis of rotation of the base passes through at least one button other than that pushed, the two other buttons if the triangle is equilateral. In the case of a square, the axis of rotation of the base passes through the button located opposite the pushed button.

The present invention also relates to a knob provided with a keypad as defined above, the buttons of which are arranged around a central thumb wheel which can rotate, and also to a motor vehicle control panel equipped with such a keypad or with such a knob.

Other features, details and advantages of the invention will emerge upon reading the description given with reference to the attached drawings given by way of example, in which:

DESCRIPTION OF THE PREFERRED EMBODIMENTS

Figure 1:
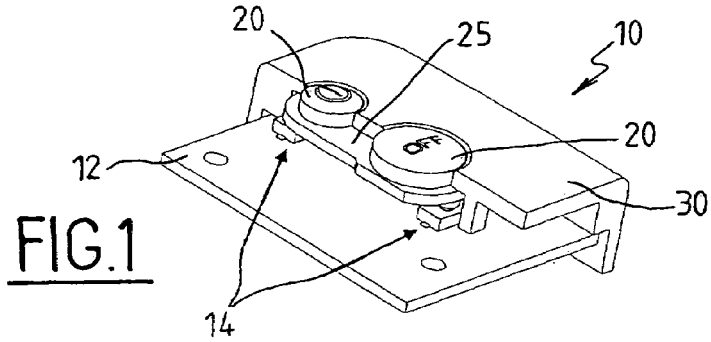
FIG. 1 shows a perspective view of a keypad comprising two buttons according to the invention.
Figure 2:
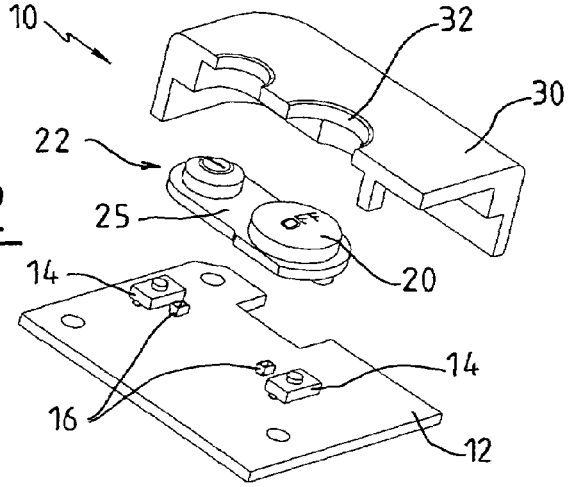
FIG. 2 shows an exploded perspective view of FIG. 1.

As shown in FIGS. 1 to 4, the keypad 10 of the present invention comprises a rigid base card 12 on which mechanical contactors 14 and light indicators 16 such as LEDs are mounted.

Each contactor 14 is associated with a button 20 mounted opposite it. The buttons 20 are grouped into a unitary set 22 and are moulded in one piece with a base 25 from rigid plastic material.

Figure 3:
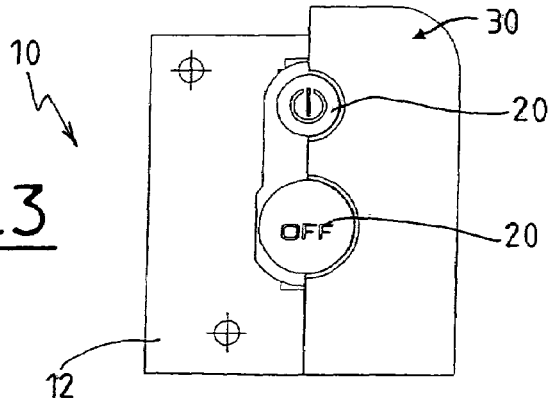
FIG. 3 shows a front view of FIG. 1.
Figure 4:
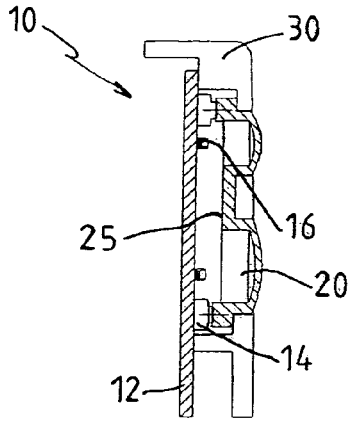
FIG. 4 shows a sectional view of FIG. 1.

A front 30 made of rigid plastic is placed over this assembly and serves to keep the buttons in position. This front 30 has openings 32 for allowing access to the buttons 20. In the assembled position, as shown in FIGS. 3 and 4, the buttons 20 rest on the contactors 14 without actuating them, and the base 25 is pressed against the front 30.

Figure 5:
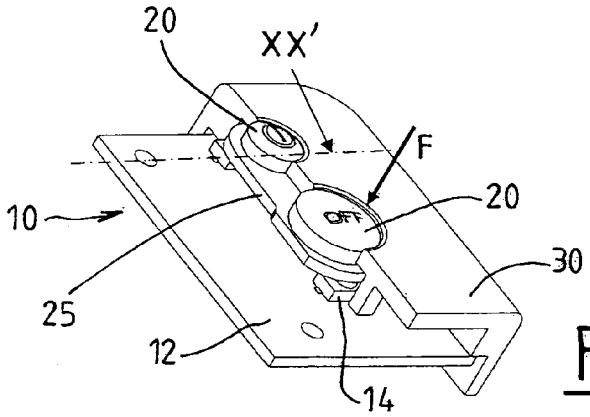
FIG. 5 shows another perspective view in which one button of the keypad has been pushed.
Figure 6:
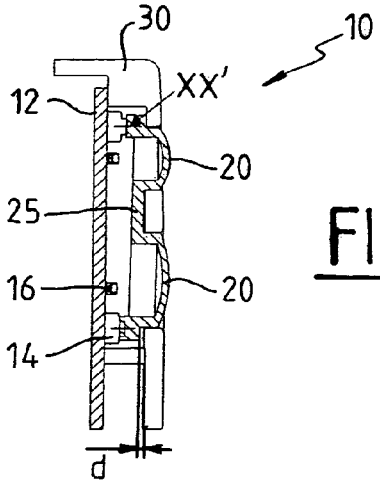
FIG. 6 shows a sectional view of FIG. 5.

During use, as shown in FIGS. 5 and 6, pushing a button 20, for example the button marked "OFF", causes the latter to be pushed in a pushing direction that is essentially perpendicular to the base 25 and is indicated by the arrow F. This pushing takes place over a travel d that is more or less equal to 0.5 mm. Pushing the button 20 thus makes it possible to actuate the contactor 14 associated therewith. This pushing is accompanied by a rotation of the base 25 about an axis XX' that is essentially perpendicular to said pushing direction F and passes through the other button, essentially at the point of contact between said other button and its associated contactor. This pivoting of the base 25 makes it possible to prevent the contactor other than the one associated with the pushed button from being actuated. Thus, pushing a button brings about displacement thereof and actuation solely of its associated contactor, without any effect on the other contactors. The rotation about the axis XX' is almost imperceptible since the user does not see the other button move.

This mode of operation is also found in variant embodiments in FIGS. 7 to 10.

Figure 7:
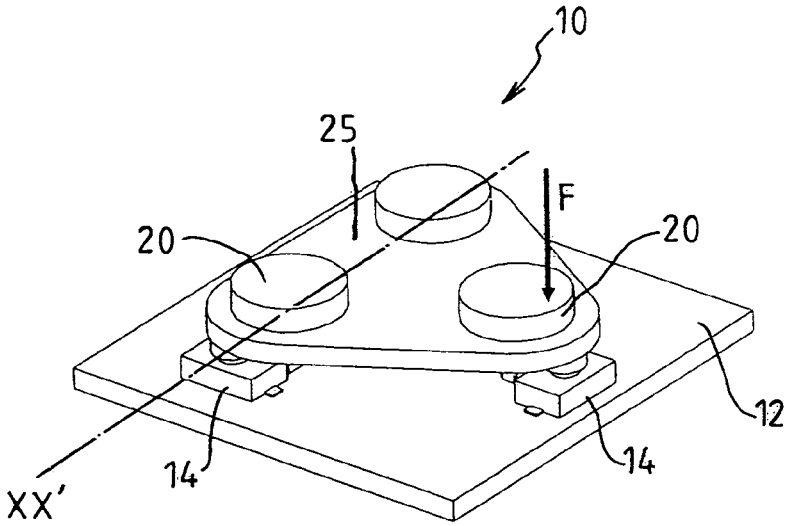
FIG. 7 shows a perspective view of a variant embodiment of the invention in which the keypad has three buttons.

Thus, in FIG. 7, the keypad 10 has three buttons 20 which in the present case form an equilateral triangle. Pushing a button 20, illustrated by the arrow F, brings about both displacement of said button, and hence actuation of its associated contactor 14, and also pivoting of the base 25 about an axis XX' that is essentially perpendicular to said pushing direction F and passes through the two other buttons. Only the contactor 14 of the pushed button 20 is actuated, the rotation of the base 25 preventing the other contactors 14 of the other buttons 20 from being actuated at the same time.

In these two embodiments, since the base 25 and the buttons 20 are moulded in one piece from rigid plastic, the buttons are spaced only slightly apart from one another, for example by between one millimetre and about one centimetre.

Figure 8:
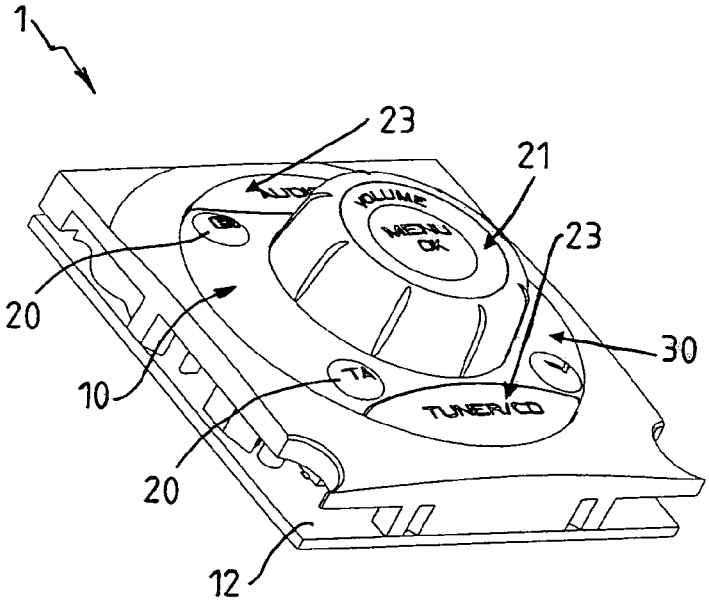
FIG. 8 shows a perspective view of a variant embodiment of the invention in which the keypad has four buttons.
Figure 9:
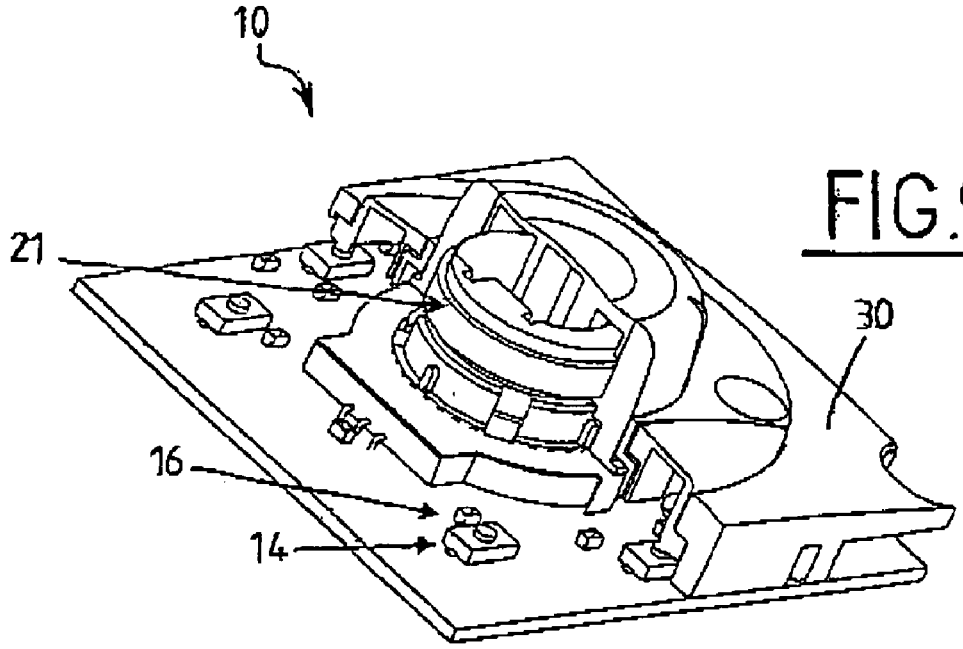
FIG. 9 shows a partially cut-away perspective view of FIG. 8.
Figure 10:
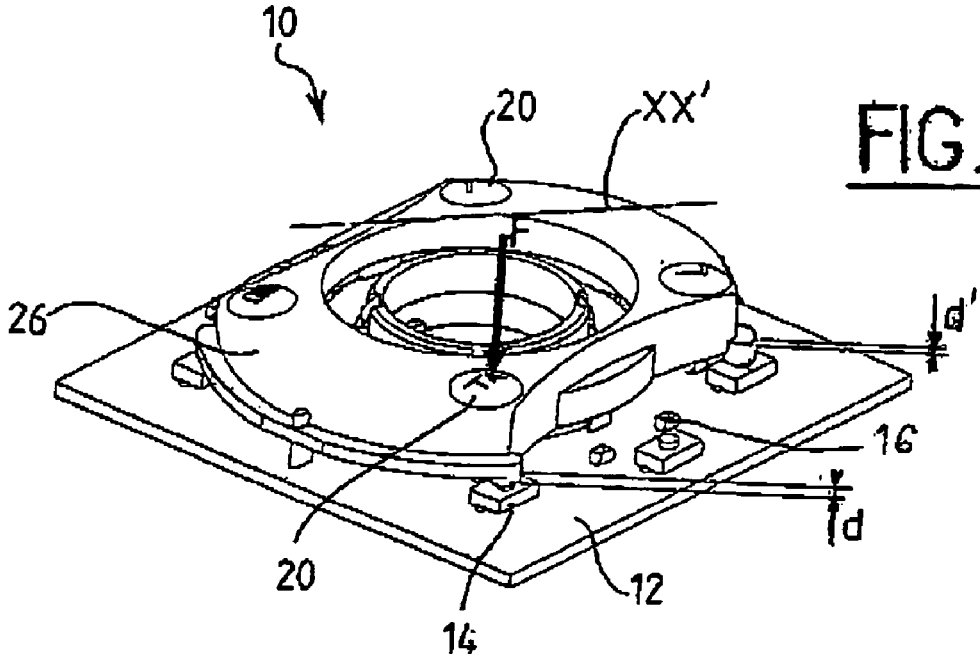
FIG. 10 shows another perspective view in which a button of the keypad of FIGS. 8 and 9 has been pushed.

In FIGS. 8 to 10, a control knob 1 is equipped with a keypad 10 having four buttons 20 which are mounted in the present case in a square around a central thumb wheel 21 which can rotate. The four buttons 20 are independent of this rotating thumb wheel 21 and are mounted on a base 26.

As can be seen in FIG. 10, pushing a button 20 in a direction F brings about displacement of said button 20 over a travel of about 0.5 mm. This displacement also causes actuation of the contactor 14 associated with said pushed button 20, which may be verified for example by a light indicator 16 being lit, and also tilting of the base 26 about an axis XX' that is essentially perpendicular to the pushing direction F of the button 20 and passes through the button located opposite the pushed button 20. The two buttons which are located next to the pushed button are pushed over a travel of a few tens of millimetres, for example 0.25 mm, without this having any influence on the operation of the keypad 10, and in particular without this causing actuation of their associated contactors. The user thus does not have the impression of pushing all the buttons at the same time. This also makes it possible to balance the base.

In this embodiment, the buttons are spaced apart from one another by one to a few centimetres.

However, it must be understood that these examples are given solely by way of illustration of the object of the invention, and do not in any way represent a limitation thereof.

It is thus possible to create a keypad having n buttons, said buttons being distributed for example in a circle in the form of a block, it being possible for each button to be moved individually.

It is also possible for the base to be flexible, in particular if the buttons are spaced very far apart from one another or if there are a very large number of buttons.

What is claimed is:

1. Keypad (10) for a control panel in a motor vehicle instrument system, comprising a front (30) provided with openings (32) through which a number of push-buttons (20) are placed, each push button positioned facing a contactor (14) fixed to a card (12), in which the buttons (20) are secured to a common base (25; 26) arranged under the front (30) so that pushing a given button (20) to actuate its associated contactor (14) causes the base (25; 26) to tilt, without jamming, about an axis XX' that is essentially perpendicular to the pushing direction of said button and passes through at least one other button (20) of the set of buttons (22) and wherein the buttons (20) are linked together at least in groups of two to form a unitary set (22) and are placed with respect to one another on the keypad (10) such that each button (20) is individually movable and pushing thereof causes solely actuation of the contactor (14) assigned to said button, without any effect on the contactors of the other buttons in which the displacement travel (d) of each button (20) is between about 0.25 and 1.5 mm and the base (26) is made of flexible material.

2. Keypad as in claim 1, in which the buttons (20) and their base (25; 26) are moulded in one piece by plastic injection moulding.

3. Keypad as in claim 2, in which the displacement travel (d) of each button (20) is between about 0.25 and 1.5 mm.

4. Keypad as in claim 2, in which the buttons (20) are spaced apart from one another laterally by one millimetre to about one centimetre.

5. Keypad as in claim 2, in which there are two buttons (20).

6. Motor vehicle control panel equipped with a keypad (10) as in claim 2.

7. Keypad as in claim 1, in which there are two buttons (20).

8. A motor vehicle control panel equipped with a keypad (10), the keypad, comprising a front (30) provided with openings (32) for two push-buttons (20), each push button positioned facing a contactor (14) fixed to a card (12), wherein the buttons (20) are linked together to form a unitary set (22) and are placed with respect to one another on the keypad (10) such that each button (20) is individually movable and pushing thereof causes solely actuation of the contactor (14) assigned to said button, without any effect on the contactors of the other buttons, in which the displacement travel (d) of each button (20) is between about 0.25 and 1.5 mm, the base (25) and the buttons (20) are made of rigid material, the buttons (20) are spaced apart from one another laterally by one millimetre to about one centimetre.

9. Keypad as in claim 8, in which there are two buttons (20).

10. Keypad (10) for a control panel in a motor vehicle instrument system, comprising a front (30) provided with openings (32) through which a number of push-buttons (20) are placed, each push button positioned facing a contactor (14) fixed to a card (12), in which the buttons (20) are secured to a common base (25; 26) arranged under the front (30) so that pushing a given button (20) to actuate its associated contactor (14) causes the base (25; 26) to tilt, without jamming, about an axis XX' that is essentially perpendicular to the pushing direction of said button and passes through at least one other button (20) of the set of buttons (22) and wherein the buttons (20) are linked together at least in groups of two to form a unitary set (22) and are placed with respect to one another on the keypad (10) such that each button (20) is movable individually and pushing thereof causes solely actuation of the contactor (14) assigned to said button, without any effect on the contactors of the other buttons, in which there are three buttons (20) which form a triangle, and the axis of rotation XX' of the base (25; 26) passes through at least one button located opposite the pushed button.

11. Keypad (10) for a control panel, in a motor vehicle instrument system, comprising a front (30) provided with openings (32) for three push-buttons (20) are placed, each push button positioned facing a contactor (14) fixed to a card (12), wherein the buttons (20) are linked together at least in groups of two to form a unitary set (22) and are placed with respect to one another on the keypad (10) such that each button (20) is individually movable and pushing thereof causes solely actuation of the contactor (14) assigned to said button, without any effect on the contactors of the other buttons, in which the three buttons (20) form a triangle, and the axis of rotation XX' of the base (25; 26) passes through at least one button located opposite the pushed button.

12. Keypad (10) as in claim 11 further comprising a knob wherein, the buttons are arranged around a central control thumb wheel (21).

13. Keypad (10) for a control panel in a motor vehicle instrument system, comprising a front (30) provided with openings (32) through which a number of push-buttons (20) are placed, each push button positioned facing a contactor (14) fixed to a card (12), in which the buttons (20) are secured to a common base (25; 26) arranged under the front (30) so that pushing a given button (20) to actuate its associated contactor (14) causes the base (25; 26) to tilt, without jamming, about an axis XX' that is essentially perpendicular to the pushing direction of said button and passes through at least one other button (20) of the set of buttons (22) and wherein the buttons (20) are linked together at least in groups of two to form a unitary set (22) and are placed with respect to one another on the keypad (10) such that each button (20) is movable individually and pushing thereof causes solely actuation of the contactor (14) assigned to said button, without any effect on the contactors of the other buttons, in which there are three buttons (20) which form a triangle, and the axis of rotation XX' of the base (25; 26) passes through at least one button located opposite the pushed button, and in which the displacement travel (d) of each button (20) is between about 0.25 and 1.5 mm.

14. Keypad as in claim 13, in which the base (25) and the buttons (20) are made of rigid material.

15. Keypad (10) for a control panel in a motor vehicle instrument system, comprising a front (30) provided with omenings (32) through which a number of push-buttons (20) are placed, each push button positioned facing a contactor (14) fixed to a card (12), in which the buttons (20) are secured to a common base (25; 26) arranged under the front (30) so that pushing a given button (20) to actuate its associated contactor (14) causes the base (25; 26) to tilt, without jamming, about an axis XX' that is essentially perpendicular to the pushing direction of said button and passes through at least one other button (20) of the set of buttons (22) and wherein the buttons (20) are linked together at least in groups of two to form a unitary set (22) and are placed with respect to one another on the keypad (10) such that each button (20) is movable individually and pushing thereof causes solely actuation of the contactor (14) assigned to said button, without any effect on the contactors of the other buttons, in which there are three buttons (20) which form a triangle, and the axis of rotation XX' of the base (25; 26) passes through at least one button located opposite the pushed button, and in which the base (25) and the buttons (20) are made of rigid material.

16. Keypad (10) for a control panel in a motor vehicle instrument system, comprising a front (30) provided with openings (32) through which a number of push-buttons (20) are placed, each push button positioned facing a contactor (14) fixed to a card (12), in which the buttons (20) are secured to a common base (25; 26) arranged under the front (30) so that pushing a given button (20) to actuate its associated contactor (14) causes the base (25; 26) to tilt, without jamming, about an axis XX' that is essentially perpendicular to the pushing direction of said button and passes through at least one other button (20) of the set of buttons (22) and wherein the buttons (20) are linked together at least in groups of two to form a unitary set (22) and are placed with respect to one another on the keypad (10) such that each button (20) is movable individually and pushing thereof causes solely actuation of the contactor (14) assigned to said button, without any effect on the contactors of the other buttons, in which there are four buttons (20), and the axis of rotation XX' of the base (25; 26) passes through a button located opposite the pushed button.

17. Keypad as in claim 16, in which the base (25) and the buttons (20) are made of rigid material.

18. Keypad (10) for a control panel, in a motor vehicle instrument system, comprising a front (30) provided with openings (32) for four push-buttons (20) are placed, each push button positioned facing a contactor (14) fixed to a card (12), wherein the buttons (20) are linked together at least in groups of two to form a unitary set (22) and are placed with respect to one another on the keypad (10) such that each button (20) is movable individually and pushing thereof causes solely actuation of the contactor (14) assigned to said button, without any effect on the contactors of the other buttons, and the axis of rotation XX' of the base (25; 26) passes through a button located opposite the pushed button.

19. Keypad (10) as in claim 18 further comprising a knob wherein, the buttons are arranged around a central control thumb wheel (21).

20. Keypad (10) for a control panel in a motor vehicle instrument system, comprising a front (30) provided with openings (32) through which a number of push-buttons (20) are placed, each push button positioned facing a contactor (14) fixed to a card (12), in which the buttons (20) are secured to a common base (25; 26) arranged under the front (30) so that pushing a given button (20) to actuate its associated contactor (14) causes the base (25; 26) to tilt, without jamming, about an axis XX' that is essentially perpendicular to the pushing direction of said button and passes through at least one other button (20) of the set of buttons (22) and wherein the buttons (20) are linked together at least in groups of two to form a unitary set (22) and are placed with respect to one another on the keypad (10) such that each button (20) is individually movable and pushing thereof causes solely actuation of the contactor (14) assigned to said button, without any effect on the contactors of the other buttons, in which there are four buttons (20), and the axis of rotation XX' of the base (25; 26) passes through a button located opposite the pushed button, and in which the displacement travel (d) of each button (20) is between about 0.25 and 1.5 mm.

21. Keypad (10) for a control panel in a motor vehicle instrument system, comprising a front (30) provided with openings (32) through which a number of push-buttons (20) are placed, each push button positioned facing a contactor (14) fixed to a card (12), in which the buttons (20) are secured to a common base (25; 26) arranged under the front (30) so that pushing a given button (20) to actuate its associated contactor (14) causes the base (25; 26) to tilt, without jamming, about an axis XX' that is essentially perpendicular to the pushing direction of said button and passes through at least one other button (20) of the set of buttons (22) and wherein the buttons (20) are linked together at least in groups of two to form a unitary set (22) and are placed with respect to one another on the keypad (10) such that each button (20) is movable individually and pushing thereof causes solely actuation of the contactor (14) assiyned to said button, without any effect on the contactors of the other buttons, further comprising a knob wherein, the buttons are arranged around a central control thumb wheel (21).

22. Keypad (10) as in claim 21, in which the displacement travel (d) of each button (20) is between about 0.25 and 1.5 mm.

23. Keypad (10) as in claim 21, in which the base (25) and the buttons (20) are made of rigid material.

24. Keypad (10) as in claim 22, wherein the base (25) and the buttons (20) are made of rigid material.

25. Keypad (10) as in claim 21, in which the base (26) is made of flexible material.

26. A motor vehicle control panel equipped with a keypad (10), the keypad comprising a front (30) provided with openings (32) through which a number of push-buttons (20) are placed, each push button positioned facing a contactor (14) fixed to a card (12), in which the buttons (20) are secured to a common base (25; 26) arranged under the front (30) so that pushing a given button (20) to actuate its associated contactor (14) causes the base (25; 26) to tilt, without jamming, about an axis XX' that is essentially perpendicular to the pushing direction of said button and passes through at least one other button (20) of the set of buttons (22) and wherein the buttons (20) are linked together at least in groups of two to form a unitary set (22) and are placed with respect to one another on the keypad (10) such that each button (20) is movable individually and pushing thereof causes solely actuation of the contactor (14) assigned to said button, without any effect on the contactors of the other buttons in which the displacement travel (d) of each button (20) is between about 0.25 and 1.5 trim and the base (26) is made of flexible material.

27. Motor vehicle control panel equipped with a keypad (10) with a knob (1) as in claim 26.

* * * * *